United States Patent [19]

Kuraoka

[11] 4,333,753

[45] Jun. 8, 1982

[54] METHOD OF LIQUEFYING FREON GAS

[75] Inventor: Yasuo Kuraoka, Sapporo, Japan

[73] Assignee: Hoxan Corporation, Sapporo, Japan

[21] Appl. No.: 168,441

[22] Filed: Jul. 10, 1980

[51] Int. Cl.[3] ..... F25J 1/00

[52] U.S. Cl. ..... 62/9; 62/40; 62/45

[58] Field of Search ..... 62/9, 40, 22, 42, 45, 62/54

[56] References Cited

U.S. PATENT DOCUMENTS

| | | | |
|---|---|---|---|
| 2,909,903 | 10/1959 | Zimmerman | 62/40 |
| 3,119,238 | 1/1964 | Chamberlain et al. | 62/45 |
| 3,195,620 | 7/1965 | Steinhardt, Jr. | 62/45 |
| 3,250,079 | 5/1966 | Davis et al. | 62/40 |
| 3,364,687 | 1/1968 | Kolm | 62/45 |
| 3,415,069 | 12/1968 | Hauser | 62/40 |
| 3,683,589 | 8/1972 | Seitz et al. | 62/40 |

*Primary Examiner*—Norman Yudkoff

*Attorney, Agent, or Firm*—George B. Oujevolk

[57] ABSTRACT

A method of liquefying Freon gas using a vessel having an inner and an outer tank, and a jacket around the inner tank which comprises the steps of operating a vacuum pump, opening a solenoid valve to evacuate the air in the space formed between the outer periphery of the inner tank and said jacket to form a vacuum, then supplying Freon gas from a bomb into the inner tank, and cooling the Freon gas in the inner tank through a heat exchange medium such as helium in said space while supplying a cooling medium to a second space between said jacket outer wall and said outer tank inner wall space to thereby liquefy the Freon gas.

1 Claim, 1 Drawing Figure

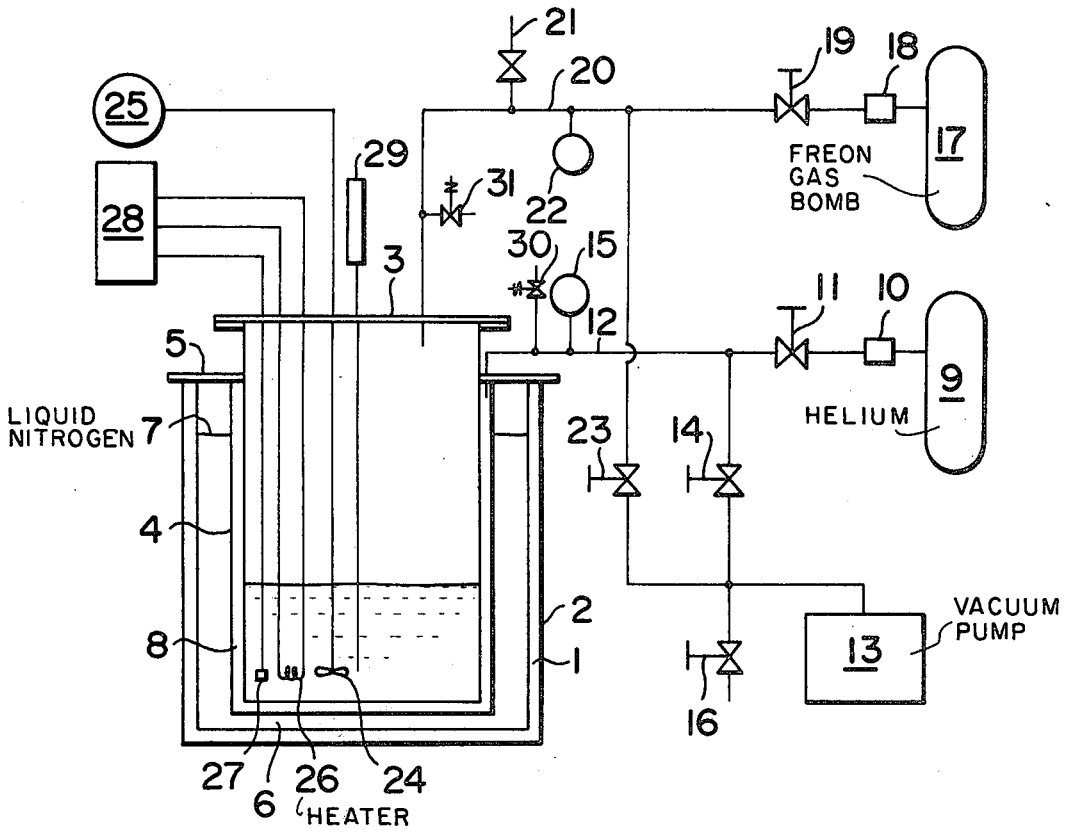
21
20
19
18
25
29
31
22
17
FREON
GAS
BOMB
28
30
15
3
11
10
12
5
9
LIQUID
NITROGEN
7
23
14
HELIUM
4
2
VACUUM
PUMP
8
1
13
16
27
6
26
24
HEATER

METHOD OF LIQUEFYING FREON GAS

BACKGROUND OF THE INVENTION

This invention relates to a method of liquefying Freon gas.

The conventional method of liquefying Freon gas employs a refrigerator or a process for cooling directly Freon gas by liquefied nitrogen. The former has the difficulty of using a very expensive apparatus, and the latter has such drawbacks that, even if Freon gas is liquefied, the liquefied Freon gas is sometimes solidified with the result that there is the danger of clogging its heat exchanger and it is very difficult to suitably regulate the rate of flow of the liquefied Freon gas so as to avoid solidification of the Freon.

SUMMARY OF THE INVENTION

Accordingly, a primary object of this invention is to provide a method of liquefying Freon gas which can eliminate the aforementioned disadvantages and drawbacks of the conventional method of liquefying Freon gas.

It is another object of this invention to provide a method of liquefying Freon gas which can also store the liquefied Freon gas simply in its liquid state.

It is yet another object of this invention to provide a method of liquefying Freon gas which does not use an expensive apparatus for carrying out the method.

It is still another object of this invention to provide a method of liquefying Freon gas which can prevent the liquefied Freon gas from being solidified by agitating the Freon gas to thereby disturb and prevent solidification of the Freon gas.

It is still another object of the invention to provide a method of liquefying Freon gas which can control the temperature of the Freon material.

BRIEF DESCRIPTION OF THE DRAWINGS

The above and other related objects and features of the invention will be apparent from a reading of the following description of the disclosure found in the accompanying drawing and the novelty thereof pointed out in the appended claims.

FIG. 1 is a schematic explanatory view of one preferred embodiment of an apparatus for carrying out the method of liquefying Freon gas according to this invention.

DESCRIPTION OF THE PREFERRED EMBODIMENTS

Reference is now made to a drawing showing one preferred embodiment of an apparatus for performing the method of liquefying Freon gas according to this invention.

The apparatus shown comprises an outer tank 2 surrounded by a heat insulating barrier 1 formed by a vacuum space or the like on the outer periphery thereof, an inner tank 4 closed by a cover 3 and inserted into the outer tank 2 and fixedly secured to the cover 5 of the outer tank 2, and cooling liquefied gas 7 such as liquefied nitrogen or the like contained in a refrigerant space 6 formed between the outer tank 2 and the inner tank 4.

The apparatus also comprises a heat exchange space 8 formed at the outer periphery of the inner tank 4, a heat exchange medium bomb 9 having a heat exchange medium such as helium gas, hydrogen gas, etc. connected through a pressure regulator 10 and a heat exchange medium supply solenoid valve 11 by a heat exchange medium tube 12 to the space 8, a vacuum pump 13 connected through an exhaust solenoid valve 14 to the space 8, a pressure gauge 15 provided at the tube 12, and a vacuum pump leakage solenoid valve 16.

The apparatus also comprises a Freon gas bomb 17 having a Freon gas such as Freon-13 connected through a pressure regulator 18 and a Freon gas supply solenoid valve 19 supplying the gas by a Freon gas tube 20 to the inner tank 4, a Freon gas recovery port 21 provided at the tube 20, a Freon gas pressure gauge 22 attached to the tube 20. The vacuum pump 13 is connected through an inner tank evacuation solenoid valve 23 to the tube 22.

The inner tank 4 possesses an agitator 24 internally provided therein at the lower portion and rotatable by an external motor 25, a temperature sensor 27 such as a platinum temperature measuring resistor or the like provided therein, a heater 26 internally mounted, the sensor 27 and the heater 26 connected to a PID (Proportable Integral Differential) controller 28, and a level gage 29 provided therein.

In order to liquefy Freon gas by this invention, the vacuum pump 13 is operated, the solenoid valve 14 is then opened to evacuate the air in the space 8 to form a vacuum, and the solenoid 11 is opened to discharge the heat exchange medium such as helium gas or the like in the bomb 9 into the space 8 so that the absolute pressure thereof is approximately at atmospheric pressure or slightly negative pressure. A safety valve 30 is provided at the tube 12.

When the solenoid valve 23 is opened, the air in the inner tank 4 is evacuated by the vacuum pump 13, and after the solenoid valve 19 is opened, the solenoid valve 19 is opened to supply Freon gas from the bomb 17 into the inner tank 4. In this case, the Freon gas supply pressure may preferably be not higher than 1 $kg/cm^2$ of gauge pressure in the inner tank 4. To this end, a safety valve 31 is provided at the tube 20.

According to this method, when the cooling liquefied gas 7 such as liquefied nitrogen or the like contained in the space 6 is thus prepared, it takes the heat of Freon gas in the inner tank 4 through the heat exchange medium such as helium gas or the like and the wall surface formed at the space 8 to cause the Freon gas to be liquefied on the bottom and inner wall surface in the tank 4.

When the Freon gas is liquefied and liquefied Freon gas is then stored in the inner tank 4, the liquefied Freon gas is agitated by the agitator 24 so that part of the liquefied Freon gas making contact with the inner wall surface of the inner tank 4 is not merely cooled to lower its temperature but is uniformly cooled at the inner wall temperature. Accordingly, no liquefied Freon gas is partially solidified.

Thus, the above operation is continued to totally liquefy the supplied Freon gas so as to thus complete the method of this invention.

According to experiments, 3 liters of Freon-13 was liquefied in two hours by using 160 dia.×400 liters of the inner tank 4.

It should be understood from the foregoing description that since the method of liquefying Freon gas according to this invention comprises the steps of inserting the inner tank 4 into the outer tank 2, filling cooling liquefied gas 7 such as liquefied nitrogen or the like in the cooling space 6 formed between the outer tank 2 and the inner tank 4, filling the heat exchange medium such as helium or the like in the heat exchange space 8 formed at the outer periphery of the inner tank 4, feeding Freon gas into the inner tank 4 evacuated to a vacuum so as to liquefy the Freon gas by the heat exchange medium via the cooling liquefied gas 7, and continuing the liquefaction of the Freon gas while agitating the liquefied Freon gas stored in the inner tank 4; the apparatus is not expensive, prevents the liquefied Freon gas from being solidified by the agitation of the Freon gas and eliminates defects in liquefying the Freon gas. It is possible to store the liquefied Freon gas in the inner tank 4 as it is, and can control the temperature of the Freon gas by the heater 26.

What is claimed is:

1. A method of liquefying Freon gas, comprising the steps of:

(a) evacuating to a vacuum an empty inner tank;

(b) forming an outer jacket about said inner tank to define a heat exchange first space which is to be occupied by a heat exchange medium;

(c) inserting said inner tank with its jacket into an outer tank of somewhat larger periphery than said inner tank and jacket to define a cooling second space between the inner wall of said outer tank and the outer wall of said jacket, so that a cooling medium can be introduced into said second space;

(d) feeding a liquified nitrogen cooling medium into said second space so as to fill up said second space;

(e) feeding helium into said first space as a heat exchange medium and sealing said helium in said first space so that the absolute pressure thereof is substantially at atmospheric pressure or at a slightly negative pressure thereto;

(f) feeding Freon gas to said inner tank vacuum to liquify said Freon gas by the nitrogen cooling medium and the helium heat exchange medium; and, (g) agitating the liquified freon stored in said inner tank to prevent solidification thereof.

* * * * *